US005695065A

United States Patent [19]

Kennedy et al.

[11] Patent Number: 5,695,065

[45] Date of Patent: Dec. 9, 1997

[54] BAG DISPENSERS AND METHOD OF DISPENSING BAGS THEREFROM

[75] Inventors: James Walter Kennedy, Buxted, United Kingdom; Antonio Macchi Cassia, Milan, Italy

[73] Assignee: David Kennedy (Engineers) Holdings Limited, United Kingdom

[21] Appl. No.: 617,185

[22] Filed: Mar. 18, 1996

[30] Foreign Application Priority Data

Mar. 21, 1995 [GB] United Kingdom ..... 9505643

[51] Int. Cl.[6] ..... B65D 83/00

[52] U.S. Cl. ..... 206/554; 206/494; 221/26; 221/45

[58] Field of Search ..... 206/39.5, 39.6, 206/39.7, 233, 494, 554; 221/26, 33, 34, 45, 48, 55, 63

[56] References Cited

U.S. PATENT DOCUMENTS

| | | | |
|---|---|---|---|
| 1,135,658 | 4/1915 | Brown et al. | 221/48 |
| 1,223,946 | 4/1917 | Fenigstein | 206/39.7 |
| 1,953,887 | 4/1934 | Medoff | 206/494 |
| 3,624,791 | 11/1971 | Taub . | |
| 3,763,623 | 10/1973 | Crouch . | |
| 4,537,330 | 8/1985 | Gelbard | 221/26 |
| 4,674,635 | 6/1987 | Huldin . | |
| 5,096,089 | 3/1992 | McLaughlin | 221/26 |
| 5,405,021 | 4/1995 | Smithson | 206/554 |

FOREIGN PATENT DOCUMENTS

| | | | |
|---|---|---|---|
| 1269157 | 4/1972 | United Kingdom . | |
| 1437831 | 6/1976 | United Kingdom . | |
| 2215306 | 9/1989 | United Kingdom . | |
| 2269367 | 2/1994 | United Kingdom . | |
| 2274098 | 7/1994 | United Kingdom . | |
| 9221274 | 12/1992 | WIPO | 221/45 |

*Primary Examiner*—David T. Fidei
*Attorney, Agent, or Firm*—Londa and Traub LLP

[57] ABSTRACT

The invention provides a bag dispenser comprising a container having a back plate intended to be attached to a vertical surface, and a cover which can be opened for loading the container with a plurality of bags and which has an opening through which the bags can be dispensed one after the other. A dividing member is provided within the container around which dividing member the bags can be folded, and the cover is hinged to the bottom of the back plate during loading of the container, whereby the bags become folded around the dividing member by the cover as the cover is closed. The invention also provides a method of dispensing bags one after the other from the container, the bags being loaded into the container so that they hang substantially vertically of the back plate, and folded around the dividing member by the step of closing the cover.

12 Claims, 8 Drawing Sheets

BAG DISPENSERS AND METHOD OF DISPENSING BAGS THEREFROM

FIELD OF THE INVENTION

This invention relates to bag dispensers. More particularly but not exclusively, the invention relates to a bag dispenser for the disposal of sanitary towels and the like. The invention also relates to a method of dispensing bags therefrom.

BACKGROUND OF THE INVENTION

In a bathroom or toilet environment, it is known to provide a wall-mounted container for bags from which a bag may be removed or dispensed for the disposal of an item. The bags may be hung within the container in the form of a flat pack, but often, in practice, more than one bag is taken at a time.

There is also a requirement for larger bags which would result in an unacceptably large container if the bags are to be stored in the manner of a flat pack.

Attempting to load bags into a container which is smaller than the bags themselves would heretofore result in loading the bags in an uncontrolled manner resulting in access being difficult.

An object of the invention is to allow bags to be housed in a container in a folded condition and yet allow them to be easily separable so that they can be dispensed one at a time.

SUMMARY OF THE INVENTION

According to the invention there is provided a bag dispenser comprising a container having a back plate intended to be attached to a vertical surface, and a cover which can be opened for loading the container with a plurality of bags and which has an opening through which the bags can be dispensed one after the other, wherein a dividing member is provided within the container around which dividing member the bags can be folded, and the cover is hinged to the bottom of the back plate so that the cover hangs down from the back plate during loading of the container, whereby the bags become folded around the dividing member by the cover as the cover is closed.

Preferably means are provided on the back plate for hanging the bags thereon.

It is also preferred that the bags have a length which results in the lower portions of the bags extending below the back plate in overlapping relation with the cover, and wherein the dividing member is mounted on the back plate to overlie the upper portions of the bags, thereby allowing the lower portions of the bags to become folded upwardly around the dividing member as the cover is closed.

The dividing member is preferably mounted for movement between an inoperative position and an operative position during loading of the container.

In one embodiment, the dividing member is a plate which is lowered in front of the bags when moved into its operative position, and the plate has stay means which enable it to remain in its raised inoperative position to assist loading of the bags into the container.

The discharge opening is preferably a vertical slot in the front wall of the cover, which slot opening is preferably aligned with the dividing plate.

Preferably the dividing plate is hinged to the top of the back plate.

The means for hanging the bags is preferably at least one hook on the back plate.

In the preferred embodiment, the bag dispenser is intended for dispensing bags sequentially from a pack of bags which are welded together adjacent their top edge to form a unitary spine and are perforated so that each bag can be torn from the spine. The spine of the pack of bags preferably has at least one hole there through for hanging the pack in the container.

The bags may be made of plastics material or paper.

The invention also provides a method of dispensing bags one after the other from a container through an opening in a cover of the container, the cover being movable between open and closed positions relative to a back plate, characterised by loading the bags into the container so that they hang substantially vertically of the back plate, and folding the bags around a dividing member provided in the container by the step of closing the cover of the container.

The container employed is preferably a bag dispenser as defined above.

DESCRIPTION OF THE PREFERRED EMBODIMENT

Figure 1:
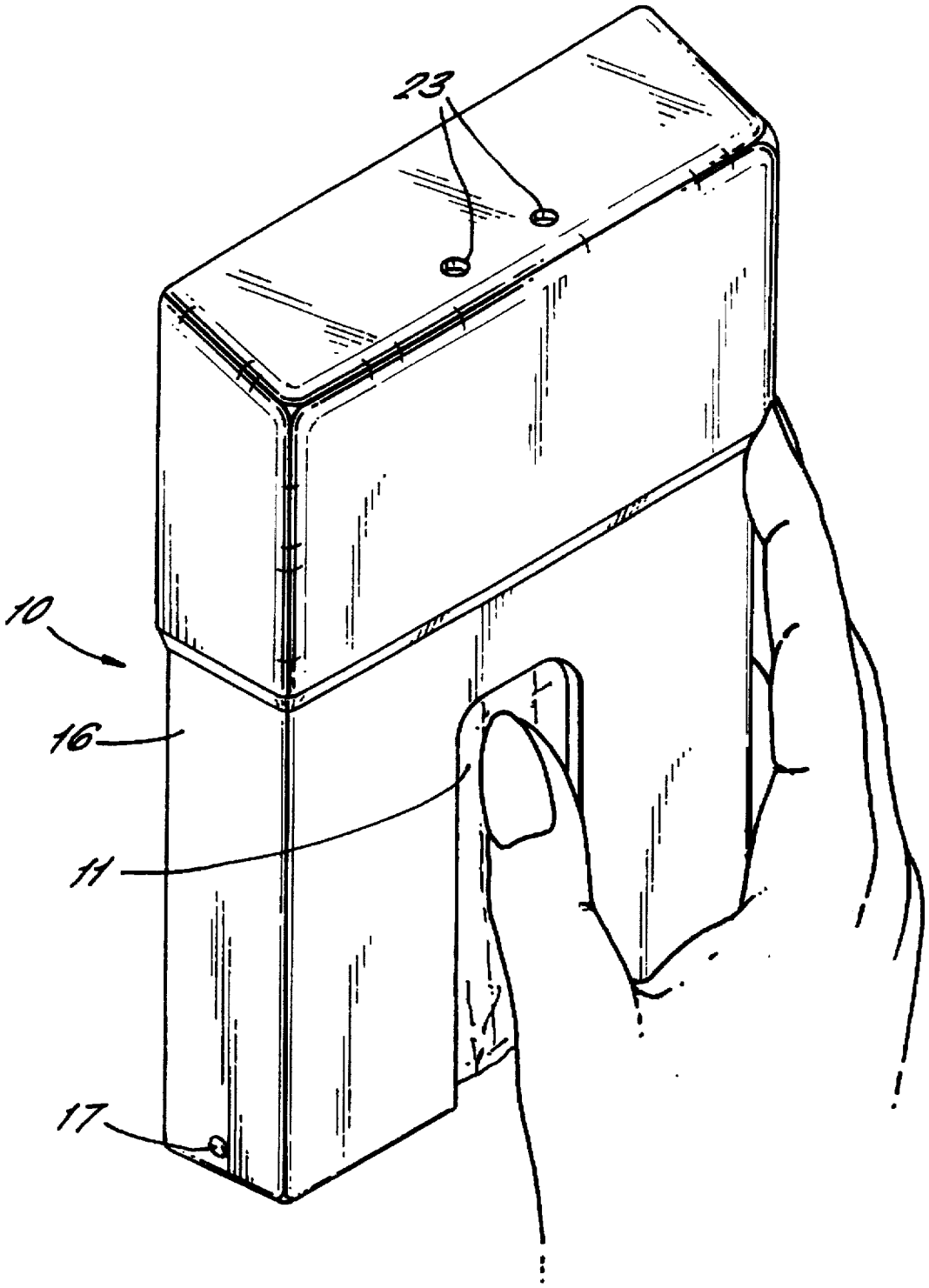
FIGS. 1 to 3 are perspective views, by way of example, of a bag dispenser showing a bag being dispensed from the container.

Referring to the drawings, a bag dispenser comprises a container 10 suitable for holding a pack of bags 11 and allowing the bags to be dispensed one at a time from the container. In this embodiment, the bag dispenser is intended for use in a bathroom or toilet environment for holding bags suitable for the disposal of sanitary towels or like items.

The container 10 comprises a back plate 12 having adhesion pads 13 initially covered with protective tape 14 and keyhole slots 15 for attachment of the back plate to a wall surface. If desired, the back plate 12 may be stuck to a wall surface and then held by a security screw applied through one or both of the keyhole slots 15.

A cover 16 is hinged by pins 17 to the bottom of the back plate 12 so that in its open position the cover hangs downwardly from the back plate. A latch 18 is provided for holding the cover closed. During closing of the cover 16, the underside of ribs 19 engage an upstanding lip 20 on the latch 18 and the latch is depressed so that the ribs become locked behind the lip when the cover is snapped shut. To open the cover, a pair of parallel arms 21 of a key 22 are inserted through holes 23 in the cover to depress the latch 18. The ramp shaped upper surface 24 of the lip 20 acts to assist release of the cover 16 when the key 22 is used to depress the latch 18, and the cover is thereby partially opened. The key 22 is then removed from the holes 23 and the cover 16 is fully opened.

Figure 7:
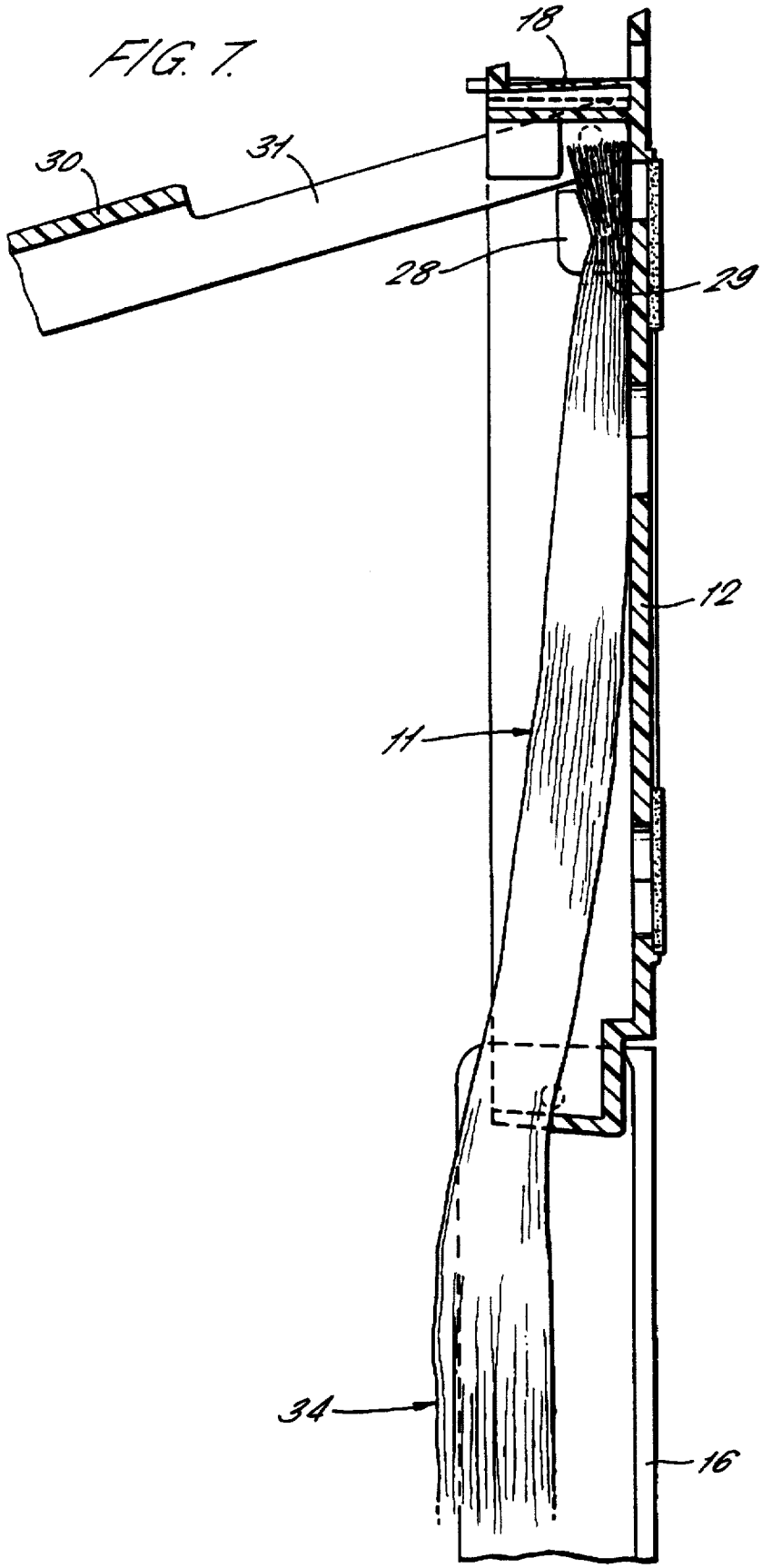
FIG. 7 is a sectional side view of the container with the dividing plate raised into its inoperative position during loading of the container with a pack of bags.
Figure 9:
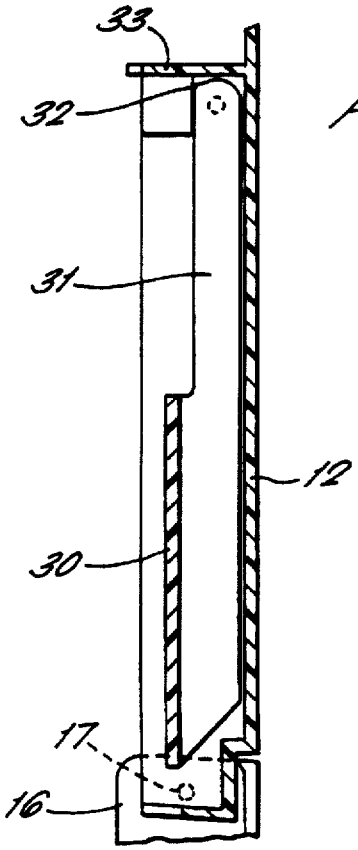
FIG. 9 is a section along line 9—9 in FIG. 4.

A vertical slot 40 in the lower portion of the front wall of the cover 16 comprises an opening through which the bags are dispensed. The bags may be made of any suitable plastics material, for example high density polyethylene or of paper. In this embodiment, the pack of bags 11 are each longitudinally gusseted and are welded together at 25 to form a spine 26. A central hole 27 through the spine 26 is provided for hanging the pack of bags on a hook 28 projecting forwardly from the back plate 12. The bags are also perforated horizontally along line 29 so that they can be torn off one at a time from the spine 26 as each bag is successively dispensed from the dispenser. The length of the bags is substantially longer than the back plate but less than twice its length. When the pack of bags is hung on the back plate during loading of the container, the lower portions 34 of the bags 11 hang below the back plate and overlap the cover (FIG. 7).

Figure 8:
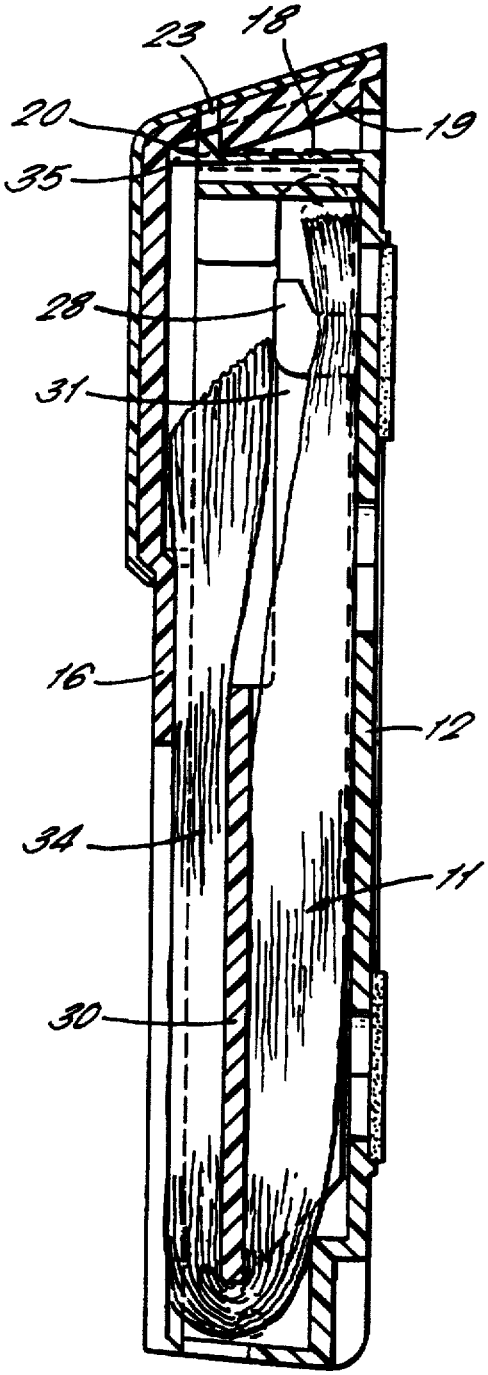
FIG. 8 shows, in section, the container with the dividing plate lowered into its operative position and the bags folded by closing the cover of the container.
Figure 6:
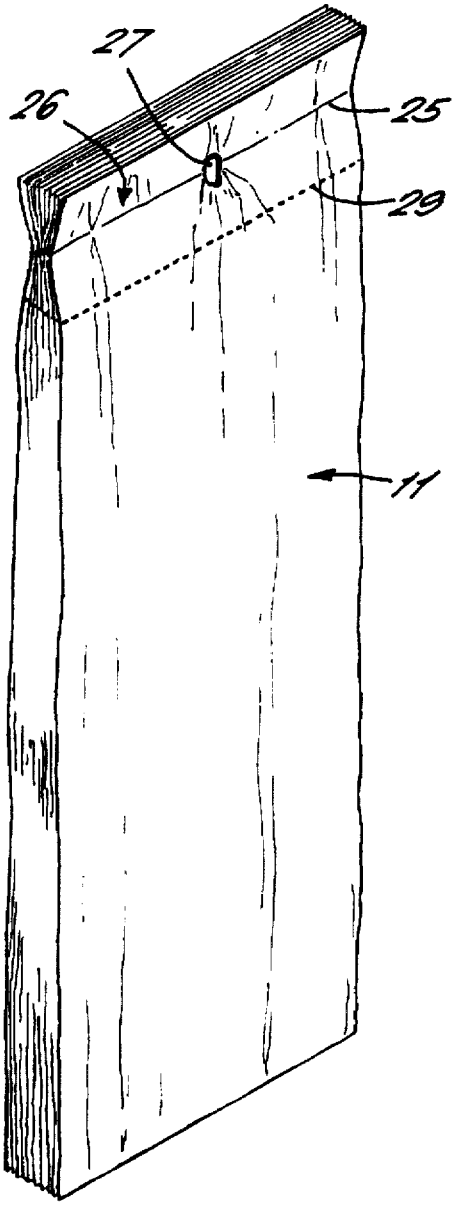
FIG. 6 illustrates a pack of bags for loading into the bag dispenser.
Figure 10:
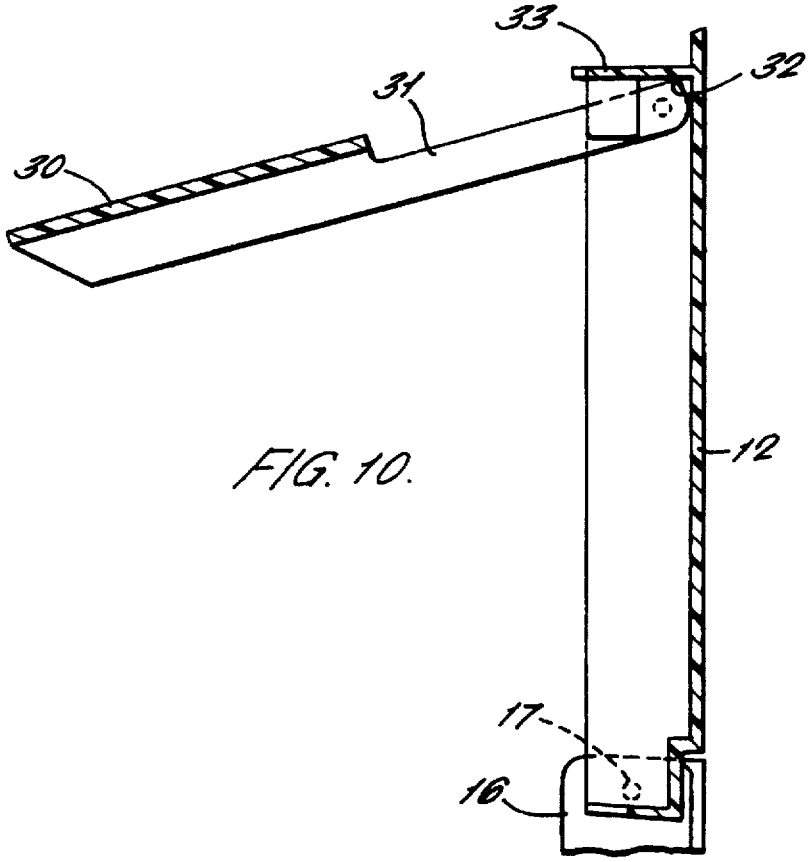
FIG. 10 is a similar view to FIG. 9 showing the dividing plate raised into its inoperative position and showing the protrusion on one of the arms of the dividing plate for maintaining the dividing plate in its inoperative position.
Figure 11:
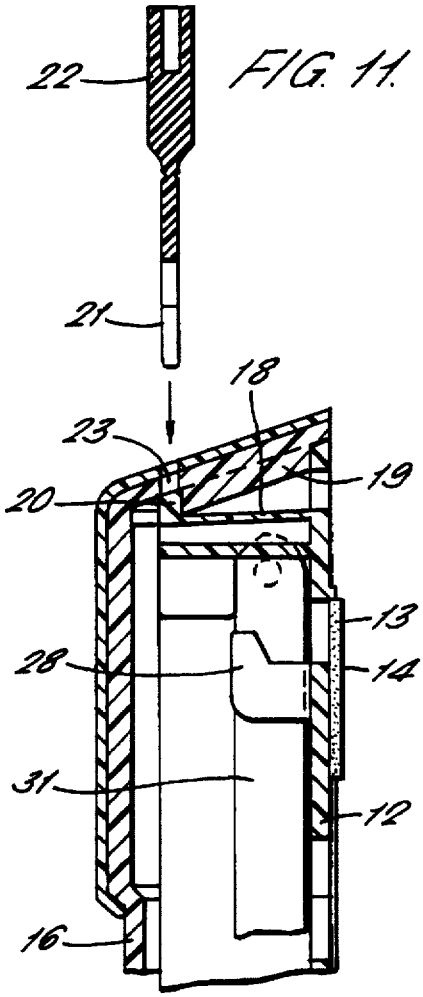
FIGS. 11 to 13 are detailed views showing the operation of a key to unlock the cover of the container.
Figure 12:
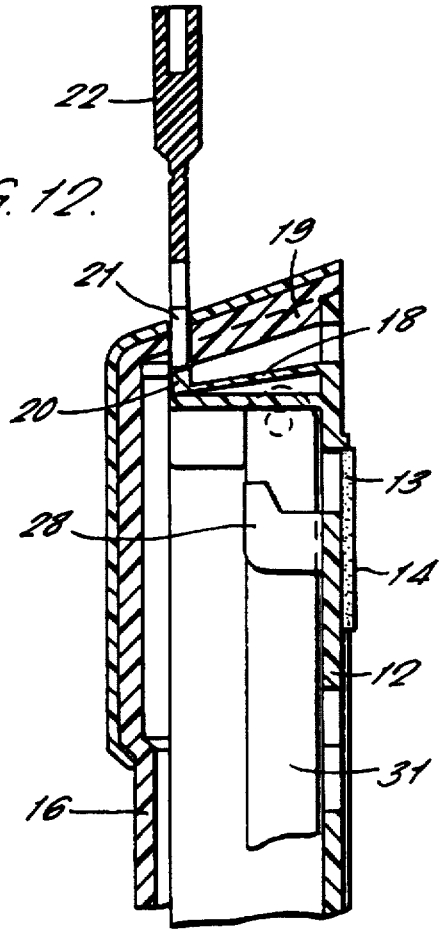
Figure 13:
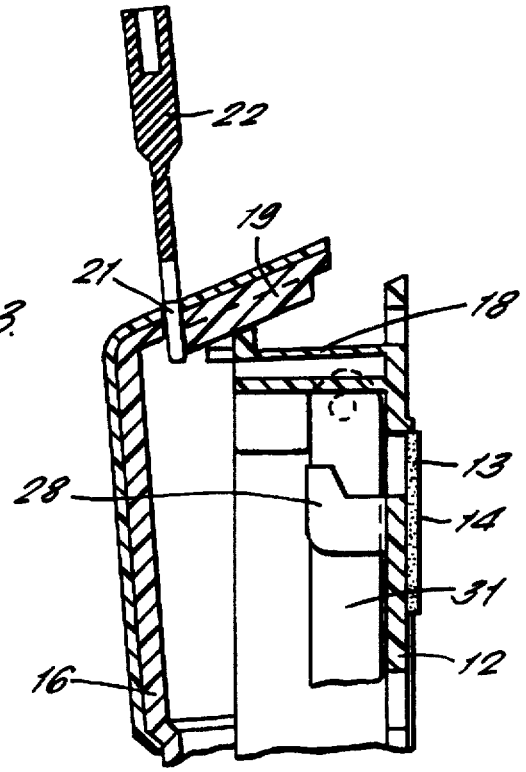

Also mounted on the back plate 12 is a dividing member which in this embodiment is a plate 30 having vertical arms 31 for swinging the plate between a raised inoperative position during loading of the container 10 and a lowered operative position in which the plate 30 is aligned with the slot 40. The arms 31 are pivotally attached to the back plate adjacent its top end. The ends of the arms are also shaped to provide a protrusion 21 which frictionally rubs against the underside of a ledge 33 of the back plate 12 during pivotal movement of the dividing plate 30. The protrusions 32 on the arms 31 thereby provide stay means which serve to maintain the dividing plate raised (FIG. 10) to facilitate loading a fresh pack of bags onto the hook 28. However, the protrusions 32 do not prevent the dividing plate 30 being moved to its lower operative position in which it overlies the upper portions of the bags 11. Closure of the cover then lifts the lower portions 34 of the bags and folds them upwardly in front of the dividing plate 30 (FIG. 8). The bags 11 are thereby loaded in a manner whereby they are accessible and can readily be dispensed one at a time from the container.

In use, the container 10 is fixed to a wall surface by adhesive pads 13 and/or screws. The cover 16 is opened using the bag 22 to depress the latch 18 and the cover then hangs downwardly from the back plate 12. The dividing plate 30 is lifted into its inoperative position in which it can hold itself due to the protrusions 32 on the arms 31 of the dividing plate engaging the underside of ledge 33 of the back plate 12. A pack of bags 11 is hung on the hook 28 so that the bags hang downwardly to a distance below the bottom of the back plate with their lower portions 34 overlying the cover 16 (FIG. 7). The dividing plate 30 is lowered into its vertical operative position. The cover 16 is then lifted, which movement causes the lower portions 34 of the bags 11 to fold about the bottom edge of the dividing plate 30 so that they are directed upwardly. The cover is finally closed against stops 35 and the ribs 19 become locked behind the lip 20 of the latch 18 (FIG. 8).

An advantage of the cover 16 being hinged to the bottom of the back plate 12 is that the bags fold themselves around the dividing plate 30 without having to be held folded whilst the cover is being closed.

Figure 2:
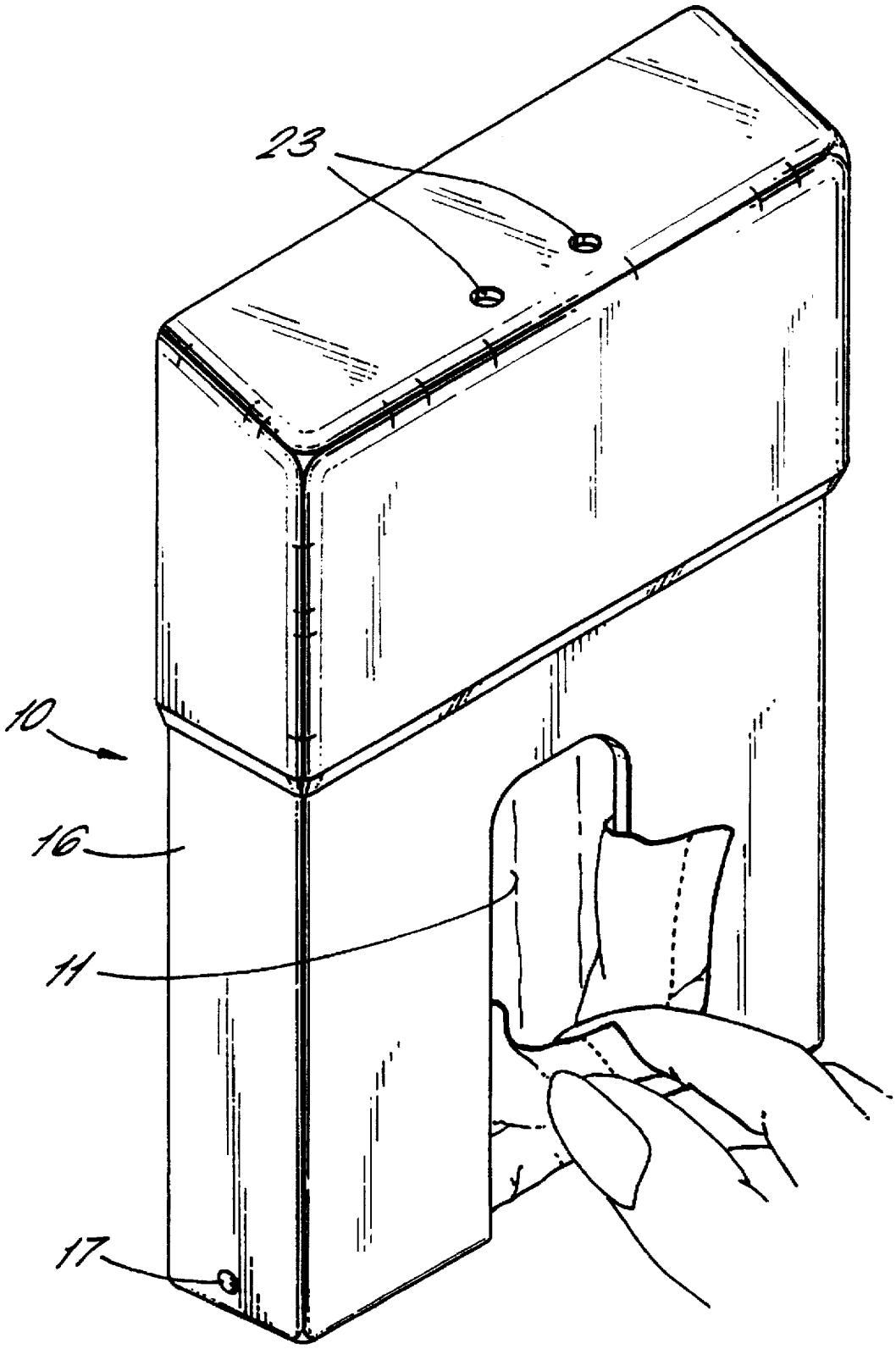
Figure 3:
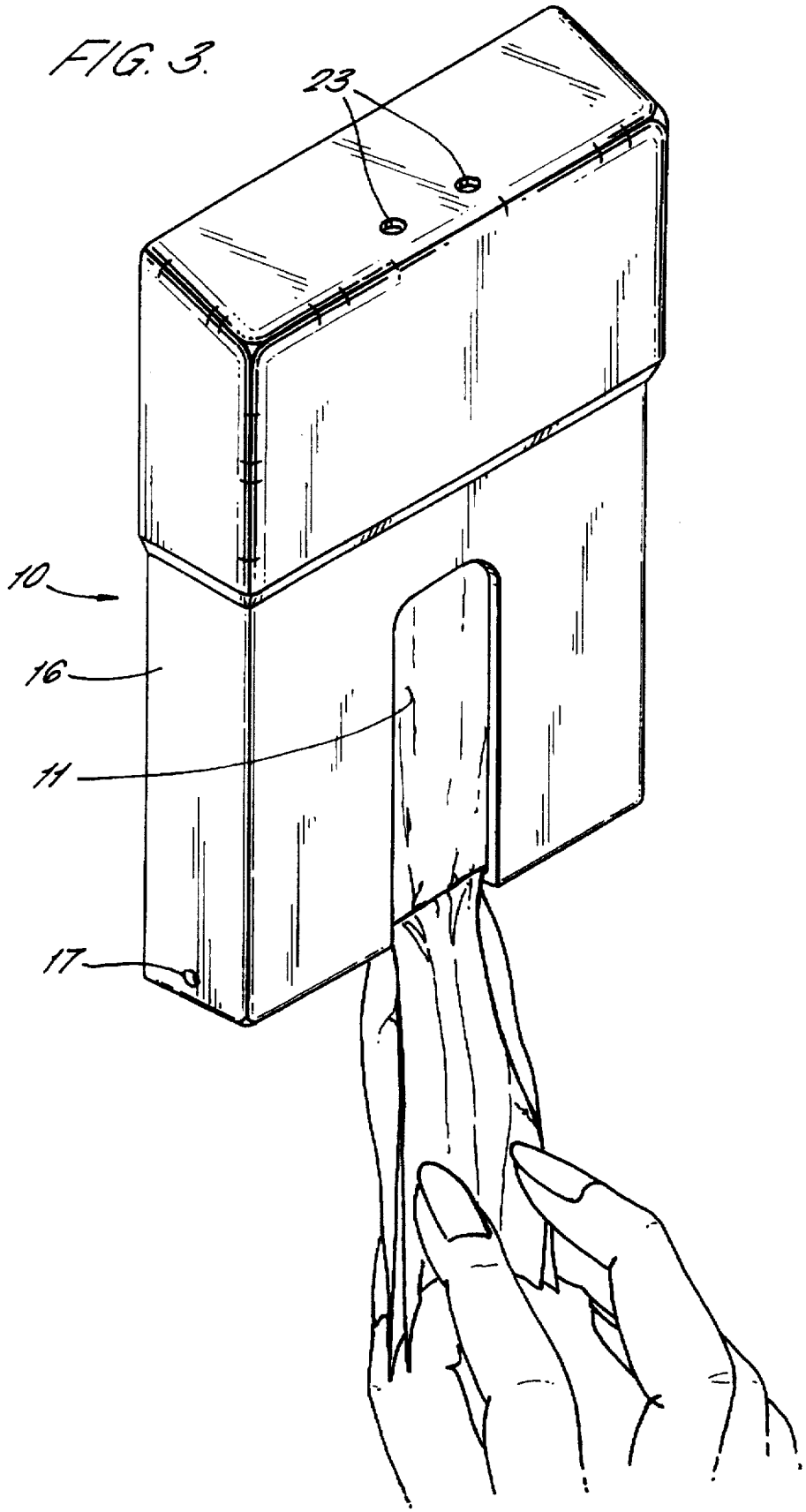
Figure 4:
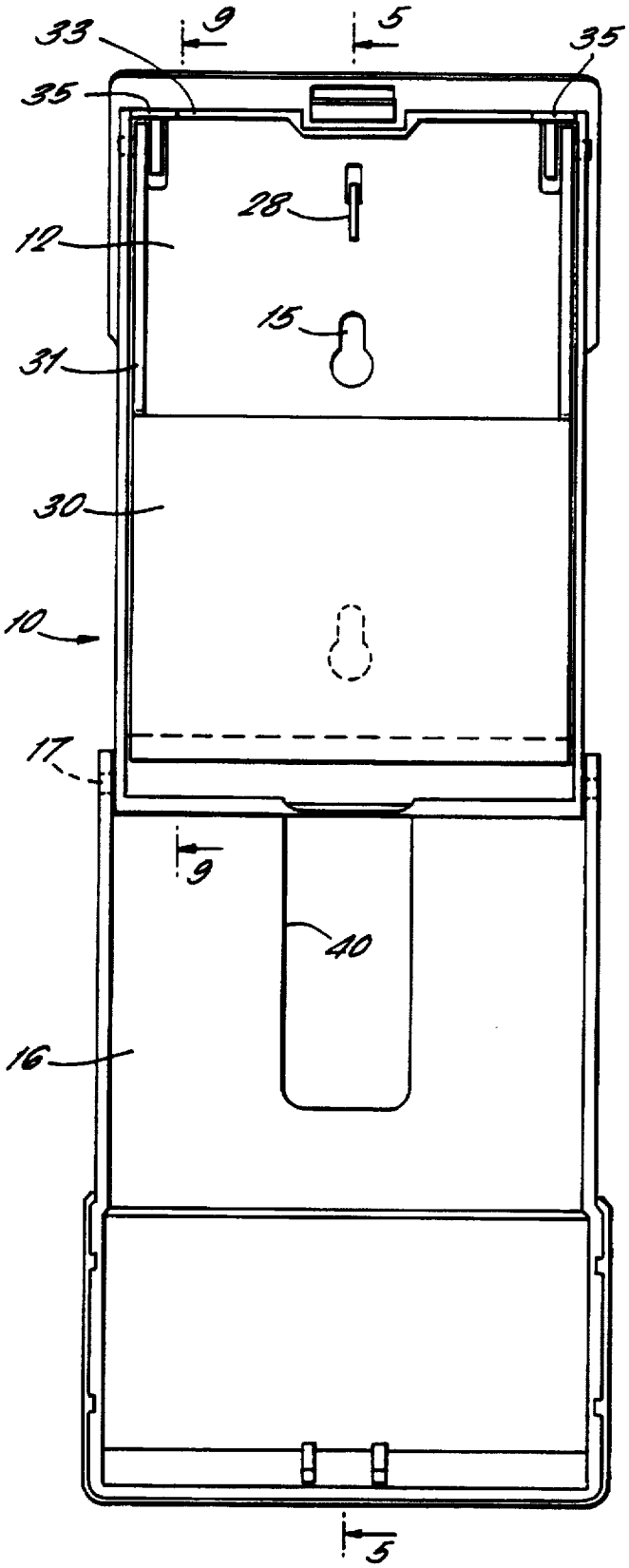
FIG. 4 is an elevation of the container with the cover in its open position.
Figure 5:
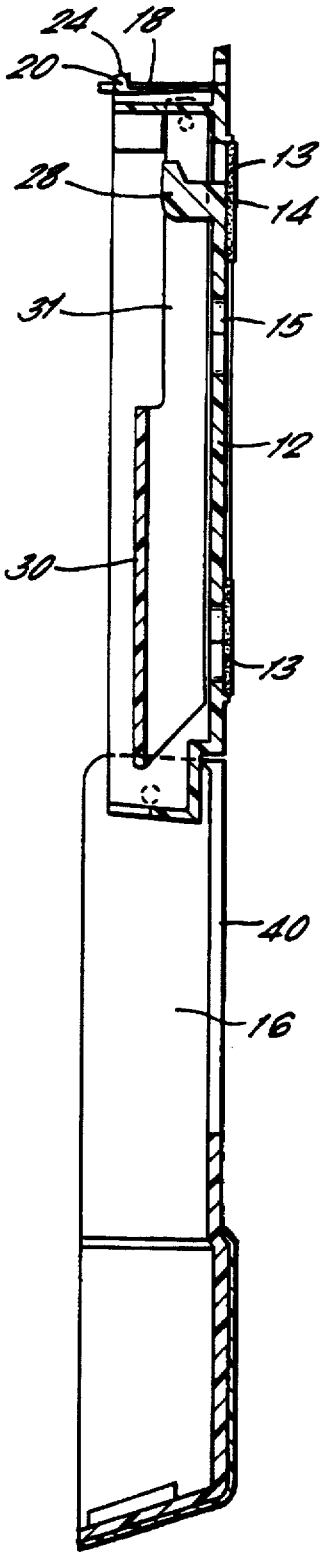
FIG. 5 is a section along line 5—5 in FIG. 4.

The bags 11 are thereby loaded neatly into the container 10 in a manner which renders the bags easily accessible to the slot opening 40 in the cover 16 through which the bags can be dispensed one at a time when required. For dispensing a bag, a person can use a thumb as shown in FIG. 1 or an index finger to rub the outer bag 11 downwardly thereby removing only one bag. When the end of the bag 11 is exposed, the bag is gripped between thumb and index finger (FIG. 2) and pulled downwardly below the container (FIG. 3). The bag 11 is then torn from the spine of the pack which is possible because of the perforations 29. Alignment of the dividing plate 30 with the slot opening 40 means that the plate 30 acts as a firm support during the initial finger pressure applied to dispense the bag 11, and the other bags remain undisturbed and neatly assembled within the container 10.

The invention is not limited to the specific details of the embodiment described above. For example, a plurality of individual bags may be loaded into the container instead of a pack of bags.

Also the dividing plate may be hinged on a side edge of the back plate for movement between its operative and inoperative positions.

Furthermore, a dividing member may be provided which comprises a transverse bar or wire instead of the plate 30. In this case, the bar or wire could be fixed to the back plate in a manner whereby the bags are tucked behind the bar or wire during loading of the bags into the container.

What we claim is:

1. A bag dispenser comprising a container having a back plate intended to be attached to a vertical surface, a cover which can be opened for loading the container with a plurality of bags, means provided on the back plate for hanging the bags therefrom, and an opening in the cover through which the bags can be dispensed one after the other, wherein a dividing member is provided within the container, the dividing member having a bottom edge around which the bags can be folded, and the cover is hinged to the bottom of the back plate so that the cover hangs down from the back plate during loading of the container, whereby the bags become folded around said bottom edge of the dividing member by the cover as the cover is closed.

2. A bag dispenser as claimed in claim 1, wherein the bags have a length which results in the lower portions of the bags extending below the back plate in overlapping relation with the cover, and wherein the dividing member is mounted on the back plate to overlie the upper portions of the bags, thereby allowing the lower portions of the bags to become folded upwardly around the dividing member as the cover is closed.

3. A bag dispenser as claimed in claim 1, wherein the dividing member is mounted for movement between an inoperative position and an operative position during loading of the container.

4. A bag dispenser as claimed in claim 3, wherein the dividing member is a plate which is lowered in front of the bags when moved into its operative position, and the plate has stay means which enable it to remain in its raised inoperative position to assist loading of the bags into the container.

5. A bag dispenser as claimed in claim 3, wherein the dividing plate is hinged to the top of the back plate.

6. A bag dispenser as claimed in claim 1, wherein the discharge opening is a vertical slot in the front wall of the cover.

7. A bag dispenser as claimed in claim 4, wherein the discharge opening is a vertical slot in the front wall of the cover, the slot being aligned with the dividing plate member.

8. A bag dispenser as claimed in claim 1, wherein the means for hanging the bags is at least one hook on the back plate.

9. A bag dispenser as claimed in claim 1, for dispensing bags sequentially from a pack of bags which are welded together adjacent their top edge to form a unitary spine and are perforated so that each bag can be torn from the spine.

10. A bag dispenser as claimed in claim 9, wherein the spine of the pack of bags has at least one hole therethrough for hanging the pack in the container.

11. A bag dispenser as claimed in claim 1, wherein the bags are made of plastics material or paper.

12. A method of dispensing bags one after the other from a container through an opening in a cover of the container, the cover being movable between open and closed positions relative to a back plate, comprising the steps of loading the bags into the container so that they hang substantially vertically from means provided on the back plate for hanging the bags therefrom, and folding the bags around a bottom edge of a dividing member provided in the container by the step of closing the cover of the container, and removal of the bags one after the other from the opening in the cover.

* * * * *